US006877962B2

(12) United States Patent
Turner et al.

(10) Patent No.: US 6,877,962 B2
(45) Date of Patent: Apr. 12, 2005

(54) DISHWASHER PUMP MOUNTING ASSEMBLY

(75) Inventors: Dwight M. Turner, Jackson, TN (US); Harry W. Dickson, Jackson, TN (US)

(73) Assignee: Maytag Corporation, Newton, IA (US)

( * ) Notice: Subject to any disclaimer, the term of this patent is extended or adjusted under 35 U.S.C. 154(b) by 232 days.

(21) Appl. No.: 10/375,843

(22) Filed: Feb. 25, 2003

(65) Prior Publication Data

US 2004/0166001 A1 Aug. 26, 2004

(51) Int. Cl.[7] ..... F04B 17/00; B08B 3/12; E05C 1/06

(52) U.S. Cl. ..... 417/360; 417/363; 417/423.15; 417/53; 292/138; 134/184; 134/174

(58) Field of Search ..... 417/360, 363, 417/424, 53, 423.15, 313; 134/184, 174, 57 D, 58 D; 292/137, 138, 145, 146, 5

(56) References Cited

U.S. PATENT DOCUMENTS

| | | | | |
|---|---|---|---|---|
| 1,660,598 A | * | 2/1928 | Crane | 292/340 |
| 3,179,307 A | | 4/1965 | Duncan et al. | |
| 3,181,903 A | * | 5/1965 | Olander | 292/5 |
| 3,355,111 A | | 11/1967 | Barnstead | |
| 3,406,637 A | | 10/1968 | Perl | |
| 3,446,155 A | | 5/1969 | Guth | |
| 3,583,826 A | | 6/1971 | Schonwald et al. | |
| 3,583,835 A | | 6/1971 | Coburn, Sr. et al. | |
| 3,603,696 A | | 9/1971 | Lampmann | |
| 4,060,346 A | | 11/1977 | Meyers | |
| 4,097,307 A | * | 6/1978 | Geiger | 134/10 |
| 4,221,547 A | | 9/1980 | Hoffmann et al. | |
| 5,118,254 A | | 6/1992 | Ellingson et al. | |
| 5,174,318 A | | 12/1992 | Dingler et al. | |
| 5,299,586 A | | 4/1994 | Jordan et al. | |
| 5,378,124 A | | 1/1995 | Welch | |
| 6,141,995 A | | 11/2000 | Johnson | |
| 6,276,908 B1 | * | 8/2001 | Batchelder et al. | 417/423.14 |

FOREIGN PATENT DOCUMENTS

EP 400731 A1 12/1990

* cited by examiner

*Primary Examiner*—Cheryl J. Tyler
*Assistant Examiner*—Timothy P. Solak
(74) *Attorney, Agent, or Firm*—McKee, Voorhees & Sease, P.L.C.

(57) ABSTRACT

A dishwasher pump mounting assembly is provided, and includes a pump mounting plate which is supported by the bottom wall of the dishwasher tub and extends through a hole in the bottom wall. A plurality of locking members secure the pump mounting plate to the bottom wall and prevent upward movement of the housing. Each lock member includes a pivotal lever moveable between locked and unlocked position, and a slideable plunger movable between extended and retracted positions within the lever. In the extended position, the plunger maintains the lever in the locked position. In the retracted position, the lever is free to be pivoted between the unlocked and locked positions.

22 Claims, 8 Drawing Sheets

DISHWASHER PUMP MOUNTING ASSEMBLY

BACKGROUND OF THE INVENTION

Dishwashing machines include a tub with a bottom wall in which a pump is mounted for supplying wash and rinse water to the spray arms of the dishwasher. The pump is typically secured to a mounting plate which is then mounted within the bottom wall of the tub, with a sealing gasket between the pump mounting plate and the tub bottom wall.

Conventional mounting means for mounting the pump mounting plate to the tub have several problems. First, the mounting mechanisms are attached and detached during the installation or repair processes. Such loose fasteners or connectors can end up being lost or misplaced. Secondly, fasteners such as screws which extend through both the housing and the bottom wall of the tub transmit the noise vibrations from the pump to the tub, which then acts as an amplifier for undesirable noise. Furthermore, conventional connectors for securing the pump housing to the tub require tools for installation and removal.

Therefore, a primary objective of the present invention is the provision of an improved dishwasher pump mounting assembly.

Another objective of the present invention is the provision of a dishwasher pump mounting assembly which is mounted on the pump mounting plate and remains in place when in both the locked and unlocked position.

A further objective of the present invention is the provision of a dishwasher mounting assembly which requires no tools.

Still another objective of the present invention is the provision of a dishwasher pump mounting assembly which is quick and easy to move between locked and unlocked positions.

Another objective of the present invention is the provision of an improved method of mounting a pump to the tub of a dishwasher.

Yet another objective of the present invention is the provision of a dishwasher pump mounting assembly which is economical to manufacture, and durable and efficient in use.

These and other objectives will become apparent from the following description of the invention.

SUMMARY OF THE INVENTION

The dishwasher pump mounting assembly of the present invention includes a pump mounting plate which extends through a hole in the bottom wall of the dishwasher tub and is supported by the annular edge of the hole. The pump of the dishwasher is mounted in the pump mounting plate. The pump mounting plate is releasably secured to the bottom wall of the tub using a plurality of lever-type locking members. Each locking member includes a lever pivotal between an unlocked position disengaged from the tub bottom wall and a locked position engaging the tub bottom wall. A slideable plunger extends into each lever and is movable between an extended position to retain the lever in the locked position, and a retracted position permitting the lever to be moved to the unlocked position. The plunger includes resilient tabs which snap fit into the lever so that the plunger is not completely removable from the lever. Thus, the levers and plungers are connected to the pump mounting plate in both the locked and unlocked positions to avoid losing any parts or pieces when the pump mounting plate is installed or removed for repair work.

DETAILED DESCRIPTION OF THE DRAWINGS

Figure 1:
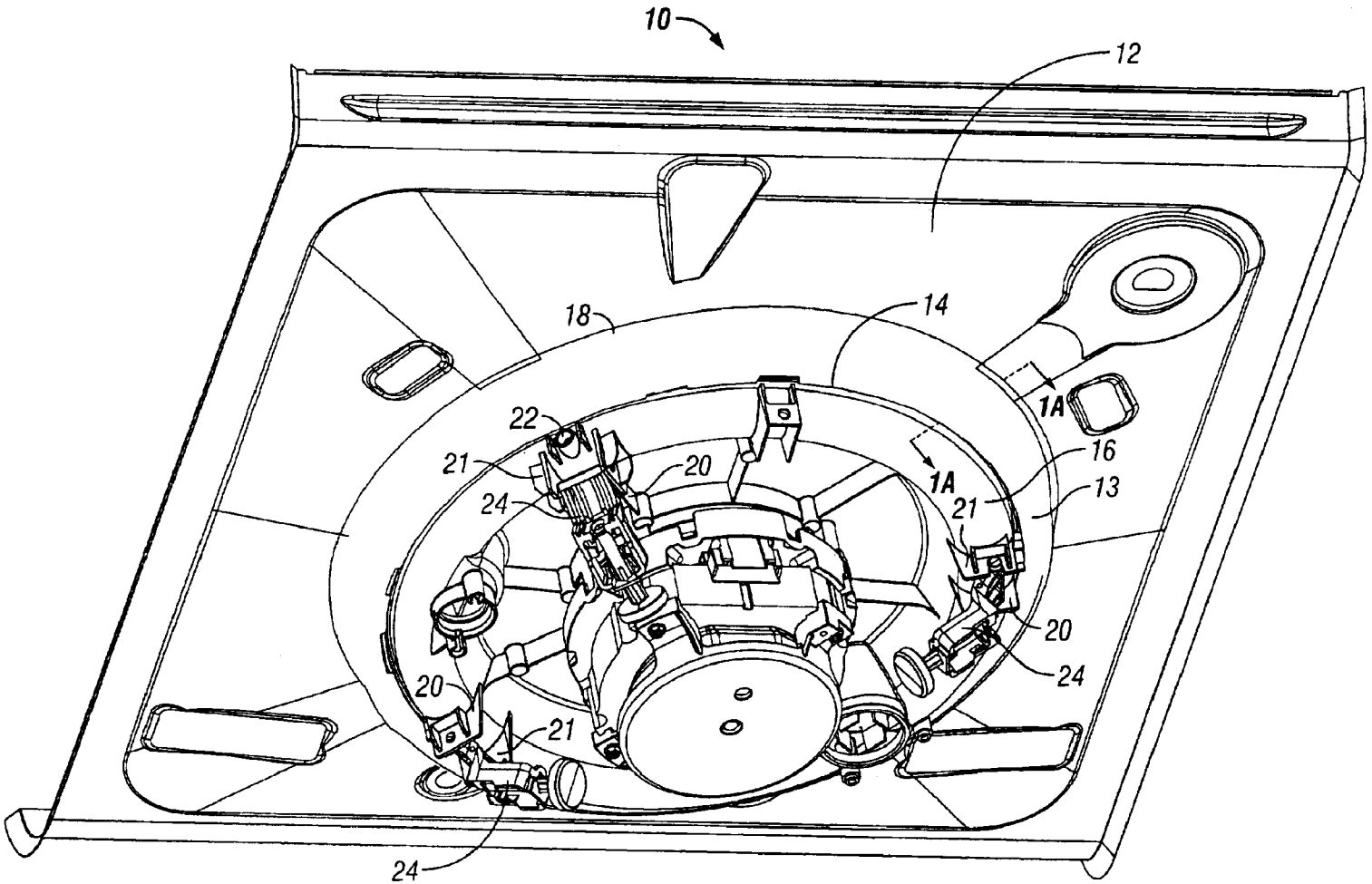
FIG. 1 is a perspective view looking upwardly at the bottom wall of the dishwasher tub and showing the pump mounting assembly of the present invention in an unlocked condition.
Figure 1A:
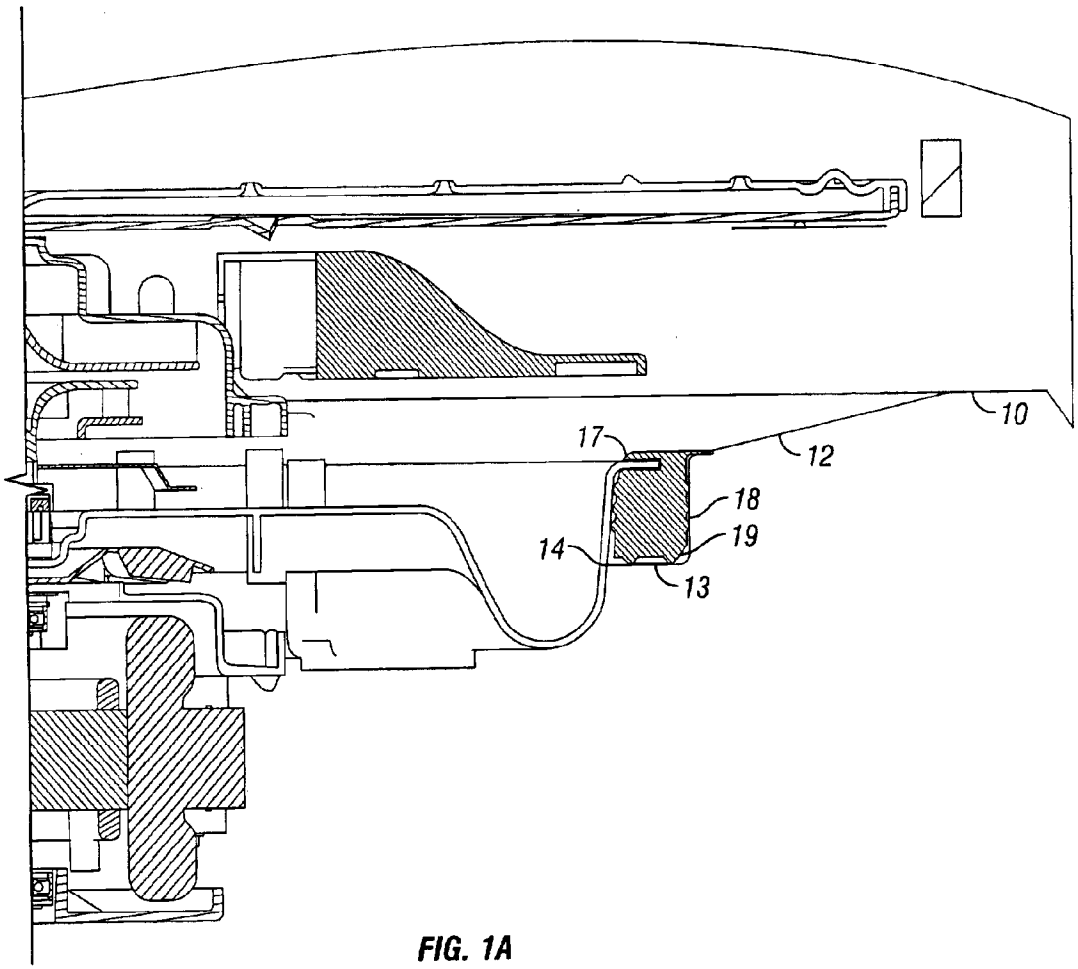
FIG. 1A is a fragmentary section view taken generally along lines 1A—1A of FIG. 1.

A conventional dishwasher tub 10 includes a bottom wall 12 having a downwardly formed annulus 18 including annular flange 13 defining a hole or opening 14 therein. A pump mounting plate 16 extends through the hole 14 and includes a perimeter flange 17, as shown in FIG. 1A, with a diameter greater than the diameter of the hole 14, such that the flange 17 is supported within the annulus 18 of the bottom wall 12 by the annular flange 13 surrounding the hole 14. A gasket 19 resides within the annulus 18 between the pump mounting plate flange 17 and the annular flange 13 to provide sealing engagement.

Figure 3:
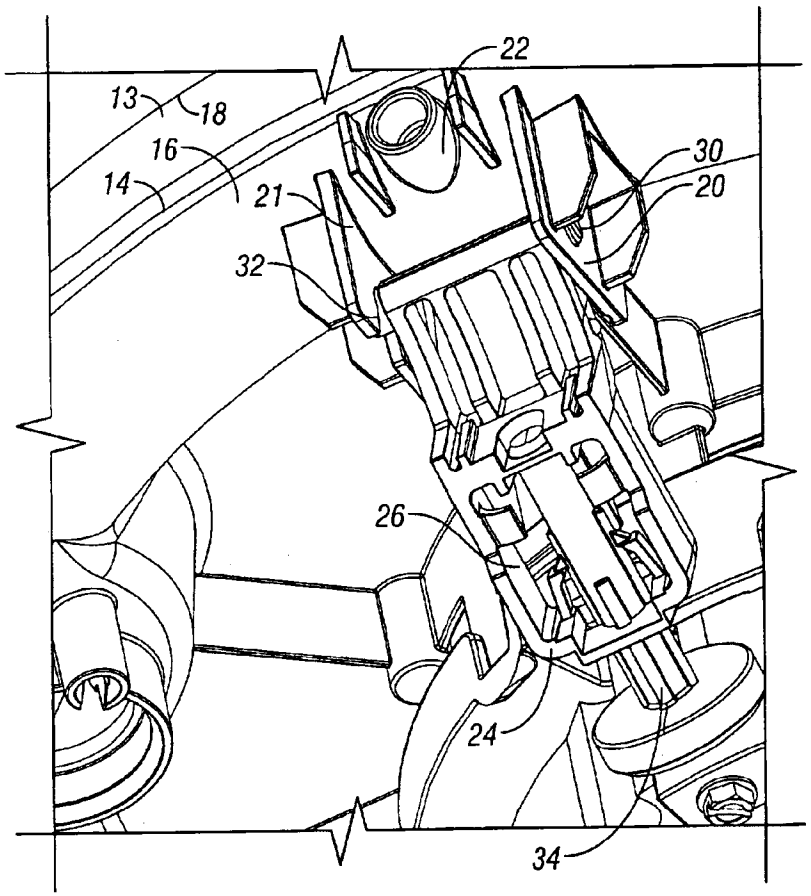
FIG. 3 is an enlarged perspective view of one of the locking members shown in the unlocked condition of FIG. 1.

The pump mounting plate 16 includes a plurality of pairs of ears 20, 21 extending downwardly from the mounting plate 16. A cylindrical boss 22 extends radially outwardly between each pair of ears 20 and 21, as best seen in FIG. 3.

Figure 2:
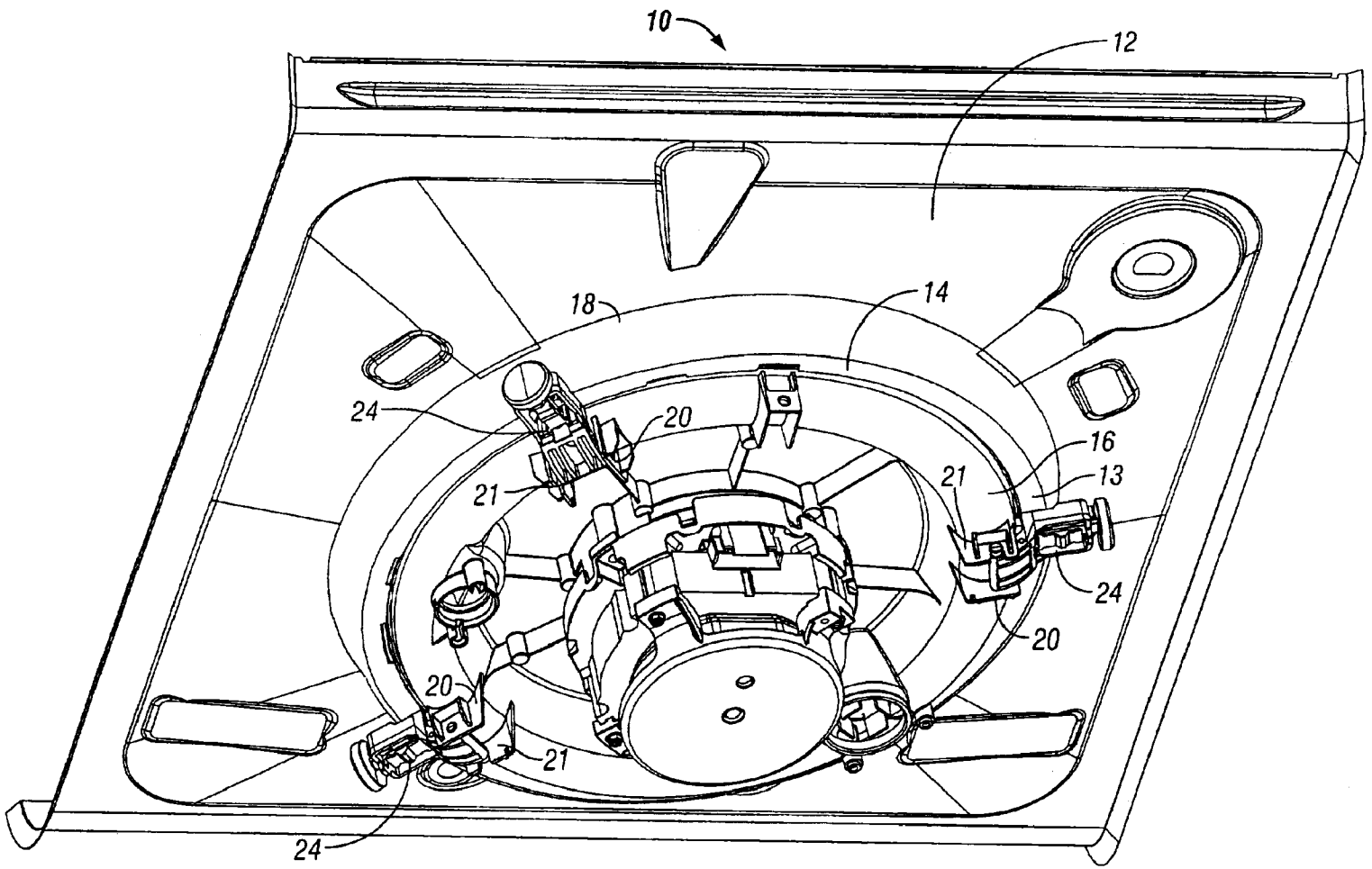
FIG. 2 is similar to FIG. 1, but shows the pump mounting assembly of the present invention in a locked condition.
Figure 4:
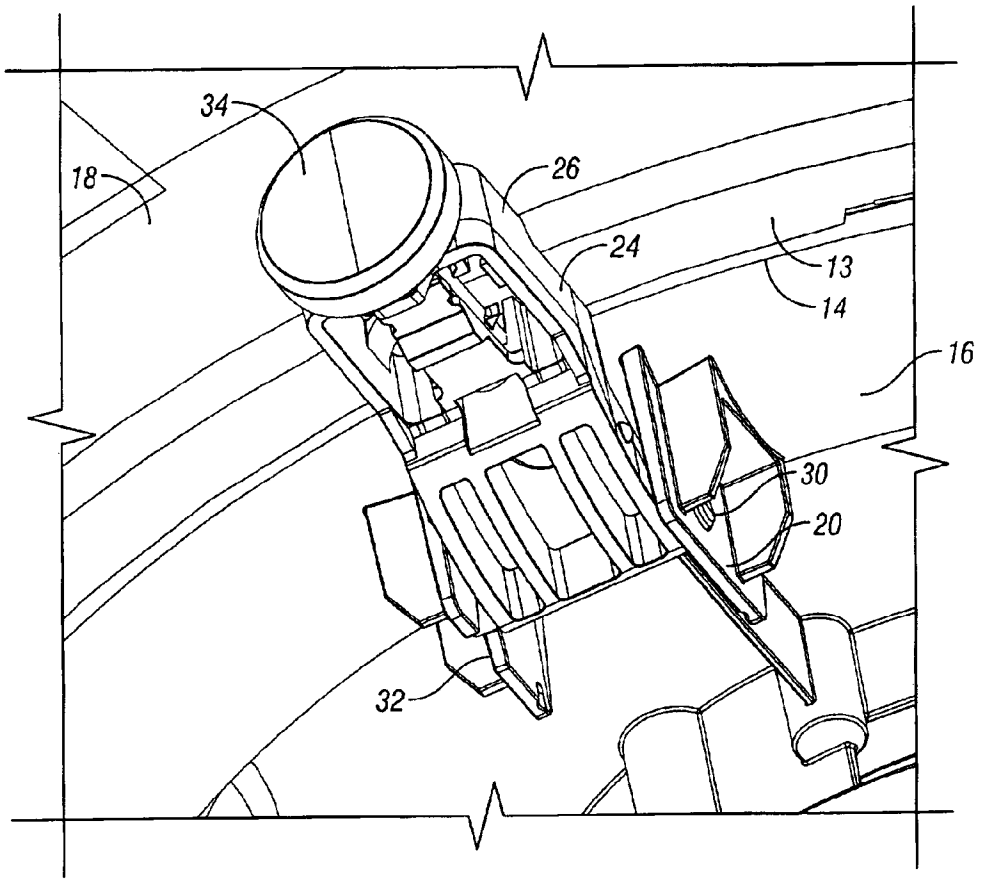
FIG. 4 is an enlarged perspective view one of the locking members shown in the locked condition of FIG. 2.
Figure 5:
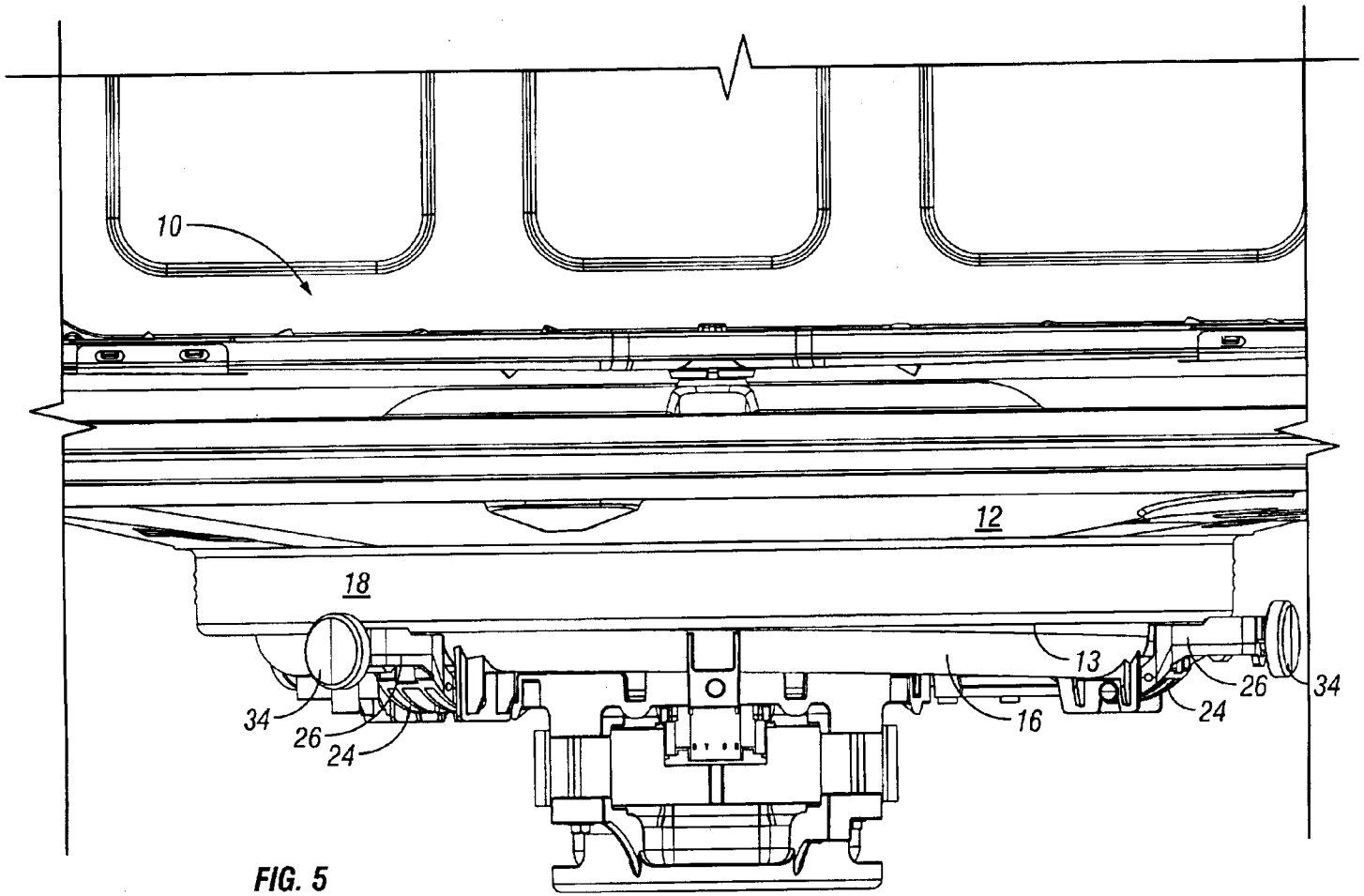
FIG. 5 is a side elevation view showing the pump mounting assembly of the present invention in a locked condition.
Figure 6:
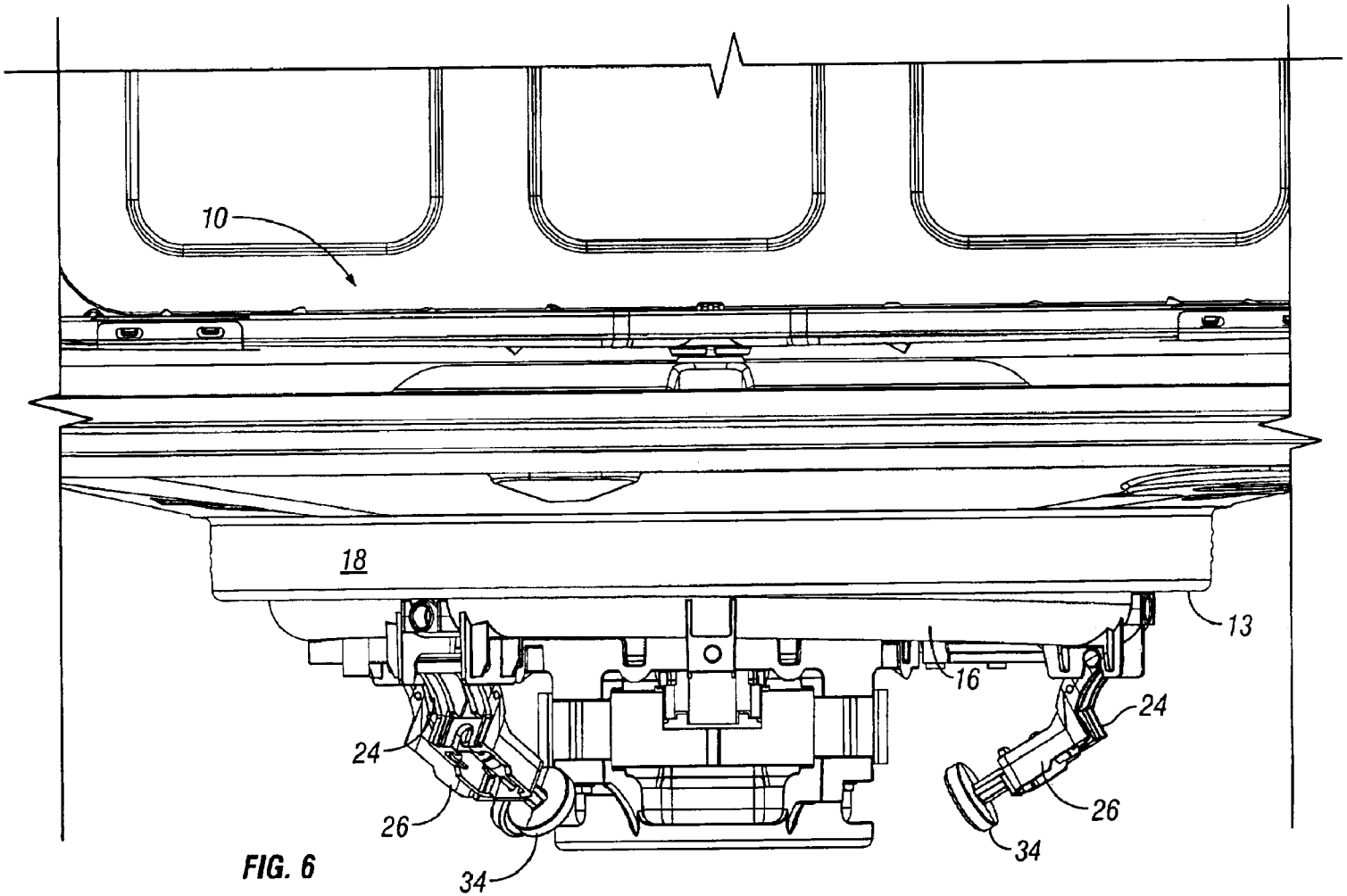
FIG. 6 is a side elevation view showing the pump mounting assembly in an unlocked condition.
Figure 7:
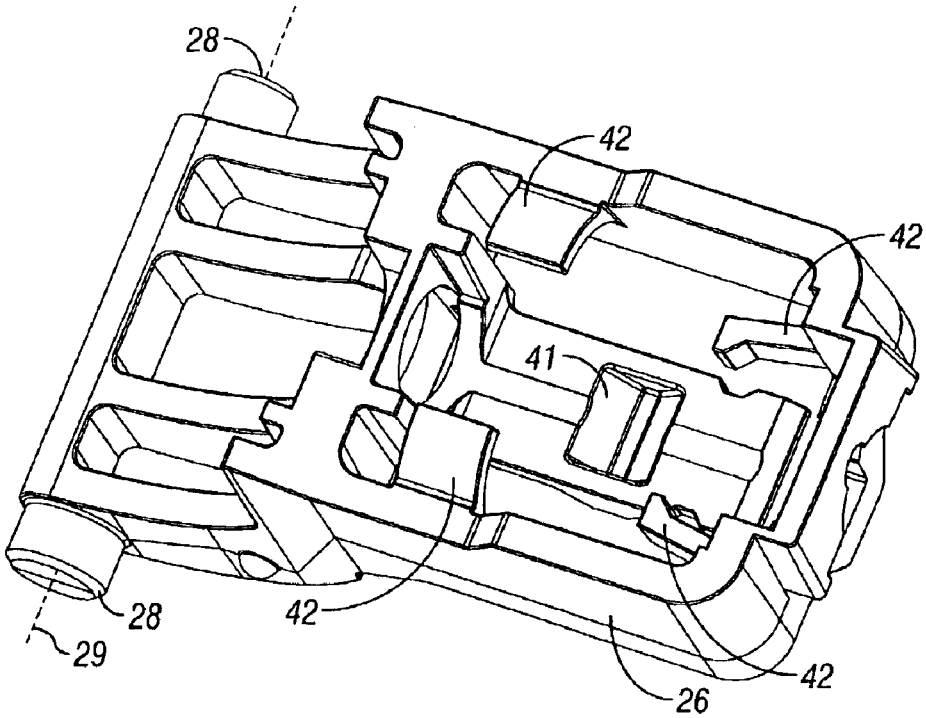
FIG. 7 is a perspective view of the lock lever of the pump mounting assembly.

The pump mounting assembly of the present invention includes locking members 24 which are movable between an unlocked position disengaged from the flange 13 of bottom wall 12 (FIG. 1) and a locked position engaging the flange 13 of bottom wall 12 (FIG. 2) so as to prevent upward movement of the pump mounting plate 16 relative to the bottom wall 12. More particularly, each locking member 24 includes a lever 26 having a pair stub shafts 28 (FIG. 7) which define a pivot axis 29 for the lever 26. One stub shaft 28 is received within a hole 30 in the ear 20, while the other stub shaft 28 is snap fit or press fit into a recess 32 in the other ear 21. The lever 26 is thus pivotal about the substantially horizontal axis 29, with the pivotal movement being between the unlocked position as shown in FIGS. 1 and 3, and the locked position shown in FIGS. 2 and 4.

Figure 8:
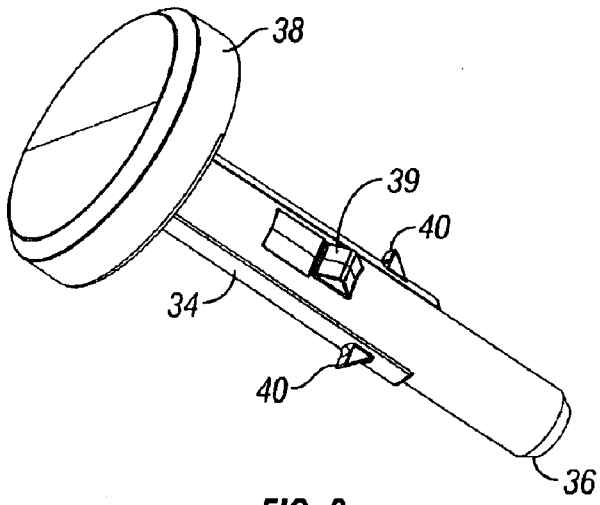
FIG. 8 is a perspective view of the plunger of the pump mounting assembly.

A slideable plunger 34 (FIG. 8) is mounted in each lever 26 and is movable between a retracted and extended position. When the plunger 34 is in the retracted position, the lever 26 is movable to and from the unlocked position (FIGS. 1 and 3). The plunger 34 has a terminal end 36 which is received in the cylindrical boss 22 of the pump mounting plate 16 when the plunger 34 is in the extended position, so as to retain the lever 26 in the locked position. The plunger 34 includes an enlarged head 38 for easy grasping for movement of the plunger 34 between the extended and retracted positions.

The plunger 34 also includes resilient tabs 40 which are adapted to snap fit past resilient arms 42 in the lever 26 so that the plunger 34 is retained in the lever 26, whether in the extended or retracted positions. Thus, the plunger 34 cannot be accidentally disconnected from the lever 26. Also, the lever 26 is not disconnected from the pump mounting plate 16 when moving between the unlocked and locked positions. The plunger 34 further has an ear 39 located between tabs 40 and enlarged head 38. The ear 39 engages a detent 41 to frictionally hold the plunger 34 in the extended or locked position. Accordingly, there are no loose or disconnected pieces which may become lost or misplaced when the pump mounting plate 16 is installed or removed for repair work.

In the initial installation of the pump mounting plate 16 into the tub 10, the gasket 19 is positioned within the annulus 18 around the hole 14 of the bottom wall 12. The pump mounting plate 16 is then set downwardly through the hole 14 such that the perimeter flange 17 engages the gasket 19 and is supported by Flange 13 of the annulus 18. During this setting step, the levers 26 of the locking members 24 are in the unlocked position and the plungers 34 of the locking members 24 are in the retracted positions, as shown in FIGS. 1 and 3. After the pump mounting plate 16 is set, the levers 26 can be rotated upwardly to a substantially horizontal position engaging the flange 13 of the annulus 18 of the bottom wall 12 of the tub 10. The plunger 34 is then inserted or extended into the lever 26 so that the end 36 resides within the cylindrical boss 22, which prevents the lever 26 from moving out of the locked position to the unlocked position.

If repair work needs to be done on the pump, the heads 38 of the plungers 34 can be easily grasped to pull the plungers 34 from the extended position to the retracted position releasing protection 39 from detent 41, thereby allowing the levers 26 to be pivoted downwardly from the locked position to the unlocked position. The pump mounting plate 16 and associated pump can then be pulled out of the tub 10 for work.

From the foregoing, it can be seen that the present invention accomplishes at least all of the stated objectives.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. In combination with a dishwasher having a tub including a bottom annulus, an assembly for mounting a pump to the tub, comprising:

a pump mounting plate resting within the bottom annulus and supporting the pump;

a plurality of locking members on the pump mounting plate and movable between an unlocked position disengaged from the tub and a locked position engaged with the tub for locking the pump mounting plate to the tub; and each locking member including a lever mounted on the mounting plate and a plunger slideably associated with the lever.

2. The assembly of claim 1 wherein the locking members are connected to the pump mounting plate in both the locked and unlocked positions.

3. The assembly of claim 1 further comprising a gasket between the pump mounting plate and the annulus.

4. The assembly of claim 1 wherein the plunger includes at least one resilient tab to preclude complete removal of the plunger from the lever.

5. The assembly of claim 4 wherein the lever includes an arm into which the tab of the plunger retentively snap fits.

6. The assembly of claim 1 wherein one of the plunger and the lever includes a projection and other of the plunger and the lever includes a detent with the projection being cooperably engageable with the detent for maintaining the plunger in the locked position.

7. The assembly of claim 1 wherein the plunger remains mounted in the lever in both extended and retracted positions.

8. The assembly of claim 1 wherein the pump mounting plate includes a boss for receiving the plunger in an extended position.

9. The assembly of claim 1 wherein the pump mounting plate includes a pair of spaced apart ears for each locking member, with each locking member having an axle for pivotal mounting to the ears.

10. The assembly of claim 1 wherein the locking members are in substantially vertical orientations in the unlocked positions and substantially horizontal orientations in the locked positions.

11. The assembly of claim 1 wherein the locking members pivot about a substantially horizontal axis.

12. A method of assembling a pump mounting plate including a pump to a dishwasher tub bottom, comprising:

setting the pump mounting plate downwardly through a hole in the tub bottom:

supporting the pump mounting plate with an annular flange extending around the hole;

moving a locking lever on the pump mounting plate from an unlocked position to a locked position to secure the pump mounting plate against upwardly movement relative to the tub bottom; and moving a plunger through the locking lever and between extended and retracted positions to retain and release the locking lever with respect to the locked and unlocked positions.

13. The method of claim 12 further comprising mounting the locking lever on the pump mounting plate for retention in both the locked and unlocked positions.

14. The method of claim 12 further comprising snap fitting the plunger to the lever for retention therein in both the extended and retracted positions.

15. The method of claim 12 further comprising installing a gasket between the tub and the pump mounting plate.

16. The method of claim 12 wherein the lever pivots between a substantially vertical orientation in the locked position and a substantially horizontal orientation in the locked position.

17. An assembly for mounting a pump in a dishwasher, the dishwasher having a tub with a hole in a bottom wall thereof, the assembly comprising:

a pump mounting plate adapted to extend through the hole in the tub and be supported by the tub and adapted to support the pump;

a plurality of lock levers movable between an unlocked position disengaged from the bottom wall and a locked position engaging the bottom wall; and a plunger associated with each lock lever and being slidable between an extended position to retain the lock lever in the locked position and a retracted position to allow the lock lever to move to the unlocked position.

18. The assembly of claim 17 further comprising a boss on the pump mounting plate to receive the plunger in the extended position.

19. The assembly of claim 17 wherein each plunger has a resilient tab to snap fit into the lock lever and preclude complete removal of the plunger from the lock lever.

20. The assembly of claim 17 wherein the lock lever is secured to the pump mounting plate in both the locked and unlocked positions.

21. The assembly of claim 17 wherein the pump mounting plate includes a pair of spaced apart ears and each lock lever includes an axle for pivotal mounting between of the pairs of ears.

22. The assembly of claim 17 wherein one of the lock lever and the plunger includes a projection and the other of the lock lever and the plunger includes a detent with the projection being cooperably engageable with the detent for maintaining the plunger in the extended, locked position.

* * * * *